US006127941A

United States Patent [19]

Van Ryzin

[11] Patent Number: 6,127,941

[45] Date of Patent: Oct. 3, 2000

[54] REMOTE CONTROL DEVICE WITH A GRAPHICAL USER INTERFACE

[75] Inventor: John M. Van Ryzin, Madison, N.J.

[73] Assignees: Sony Corporation, Tokyo, Japan; Sony Electronics, Inc., Park Ridge, N.J.

[21] Appl. No.: 09/017,788

[22] Filed: Feb. 3, 1998

[51] Int. Cl.[7] ..... G08C 19/00

[52] U.S. Cl. ..... 340/825.69; 345/157; 345/168; 341/20; 341/21; 341/22

[58] Field of Search ..... 340/825.69, 825.72, 340/825.24, 825.25; 341/176, 20, 21, 22; 345/157, 168

[56] References Cited

U.S. PATENT DOCUMENTS

| | | | |
|---|---|---|---|
| 5,760,824 | 6/1998 | Hicks, III | 348/14 |
| 5,802,467 | 9/1998 | Salazar et al. | 455/420 |
| 5,819,294 | 10/1998 | Chambers | 707/104 |

FOREIGN PATENT DOCUMENTS

0566516A1 3/1993 European Pat. Off. .

*Primary Examiner*—Michael Horabik
*Assistant Examiner*—M Shimizu
*Attorney, Agent, or Firm*—Frommer Lawrence & Haug, LLP.; William S. Frommer; Bruno Polito

[57] ABSTRACT

A two-way remote control unit with a graphical user interface controls various audio/video devices interconnected in a multimedia system. The remote control unit includes a transceiver for transmitting and receiving control commands to/from multimedia components, which are displayed in the user-friendly format on a display of the remote control unit. The user can scroll, select, browse, etc. through various menu items on the display, and activate any desired function on the multimedia system component by selecting the desired representation of that function on the display. In addition, the remote control unit communicates, also through wireless transmission, with a personal computer and obtains information from remote or local databases for either controlling or enhancing the operation of the multimedia system devices.

10 Claims, 3 Drawing Sheets

REMOTE CONTROL DEVICE WITH A GRAPHICAL USER INTERFACE

BACKGROUND OF THE INVENTION

The present invention is related to wireless data transfer operations and, in particular, to a remote control device with a graphical user interface for controlling various audio/video devices interconnected in a multimedia system in a user-friendly manner.

It is well known how difficult it is to control today's multifunctional and very complex multimedia components. New technological advances, partially driven by consumer demand for new high-tech equipment, spawn more complicated components than ever, such as a 200 compact disk (CD) changer, integrated television/video cassette recorder (TV/VCR), digital audio tape (DAT) device, digital video disk (DVD) device, etc. Each of these devices perform a myriad of functions that may or may not be important to the user, but are certainly available for him to try. To control each device, a remote control unit is provided, sometimes offering all of the functions that can be performed manually, that is without the remote control, by activating switches, buttons, etc. located on the remote control unit. The ubiquitous "12:00" still blinking on many VCRs in peoples' homes still attest to the difficulty of controlling the audio/video components.

For each new multimedia device that becomes a part of the user multimedia system, the user has to study the operations manual of that device to determine what function a particular button on the remote control unit performs. Since conventional remote control units offer only limited space on their surfaces, all of the buttons (switches) located on the remote control unit are cryptically labeled that sometimes require the user to impersonate Sherlock Holmes to decipher their function. Simply looking at the remote control unit is not sufficient to guess as to what the activation of the button entails. Trial and error method of activating a function to find out what it does may not be only frustrating but also perilous as the user may accidentally erase, delete, etc. some information in a storage medium and/or stop the operation of the device without knowing how to return to its normal operation. This "experimentation" may occur at a very inopportune moment causing further frustration and requiring the user to study the operations manual or to abort the operation of the component.

Different manufacturers of system components typically have incompatible remote control units. Thus, even though the remote control unit from one manufacturer is capable of controlling several components, it is so as long as these components are made by the same manufacturer. If, for example, a TV is made by one manufacturer while a DAT is made by another manufacturer, the fact that the remote control unit of the TV is capable of controlling a DAT is of little help because the DAT owned by the user is made by a different manufacturer and cannot be controlled by the remote control unit assigned to the TV.

A conventional so-called universal remote control unit which, as known in the art, combines controlling functions of several components does not alleviate the problem associated with numerous individual remote control units associated with the multimedia components. The conventional universal remote control unit has a limited surface space and is designed to accommodate the most important (basic) functions of the components which it is designed to control. Thus, the user has to either give up those additional features of the components or study the operations manual for each component and control those additional functions manually by activating the appropriate switches, etc. located on the audio/video components.

In any event, it is inconvenient and time consuming for the user to study the operations manual and juggle several remote control units when controlling devices in his multimedia system.

A need therefore exists for a system and method for overcoming the above disadvantages.

OBJECTS OF THE INVENTION

It is an object of the present invention to provide easy-to-use remote control of audio/video devices in a multimedia system.

It is another object of the present invention to provide a graphical user interface for remotely controlling audio/video devices in a multimedia system.

It is a further object of the present invention to provide a remote control device with a graphical user interface for controlling audio/video devices and for obtaining additional information from a database, as requested from the remote control device, and for displaying the additional information on a display of the remote control device.

SUMMARY OF THE INVENTION

These and other objects, features and advantages are accomplished by a remote control device for wirelessly communicating with a multimedia system comprised of audio/video devices connected with each other, wherein the multimedia system includes a first transceiver for wirelessly transmitting and receiving a number of signals. The remote control device comprises a memory storage for storing specifications data for each of the audio/video devices. The specifications data is operative to have the audio/video devices perform a number of functions in response to command data. Further included is a user input section for inputting the command data representative of a function to be performed in at least one of the audio/video devices. The remote control device also includes a display for displaying a number of graphical objects each corresponding to a respective one of the audio/video devices, and for displaying a menu including the number of functions corresponding to each respective audio/video device such that the function is selected from the menu in response to the user input section. Also included is a programmable controller for processing the input command data corresponding to the selected function on the display. In addition, the remote control device comprises a second transceiver for transmitting to the first transceiver a first signal corresponding to the processed command data such that at least one audio/video device is operative to perform the selected function, and for receiving from the first transceiver a second signal corresponding to status data indicating whether the selected function has been performed.

In accordance with one aspect of the present invention, the remote control device further comprises a general purpose computer and a third transceiver connected to the computer such that the second transceiver transmits a third signal representing a request for information to the third transceiver. The computer accesses a database for responding to the request for information, and transfers response information to the third transceiver for transmitting a fourth signal representing the response information to the second transceiver. After the second transceiver receives the fourth signal, the programmable controller is operative to process the fourth signal and display the response information corresponding to the fourth signal on the display.

BRIEF DESCRIPTION OF THE DRAWINGS

The above-mentioned as well as additional objects, features and advantages of the present invention will become readily apparent from the following detailed description thereof which is to be read in conjunction with the accompanying drawings, in which.

In all Figures, like reference numerals represent the same or identical components of the present invention.

DETAILED DESCRIPTION OF THE PREFERRED EMBODIMENTS

As a general overview, the present invention provides a two-way remote control unit with a graphical user interface. The inventive remote control unit includes a transceiver for transmitting and receiving control commands to/from multimedia components, which are displayed in the user-friendly format on a display of the remote control unit. The user can scroll, select, browse, etc. through various menu items on the display, and activate any desired function on the multimedia system component by selecting the desired representation of that function on the display. In addition, the inventive remote control unit can communicate, also through wireless transmission, with a personal computer and obtain information from remote or local databases for either controlling or enhancing the operation of the multimedia system devices.

Figure 1A:
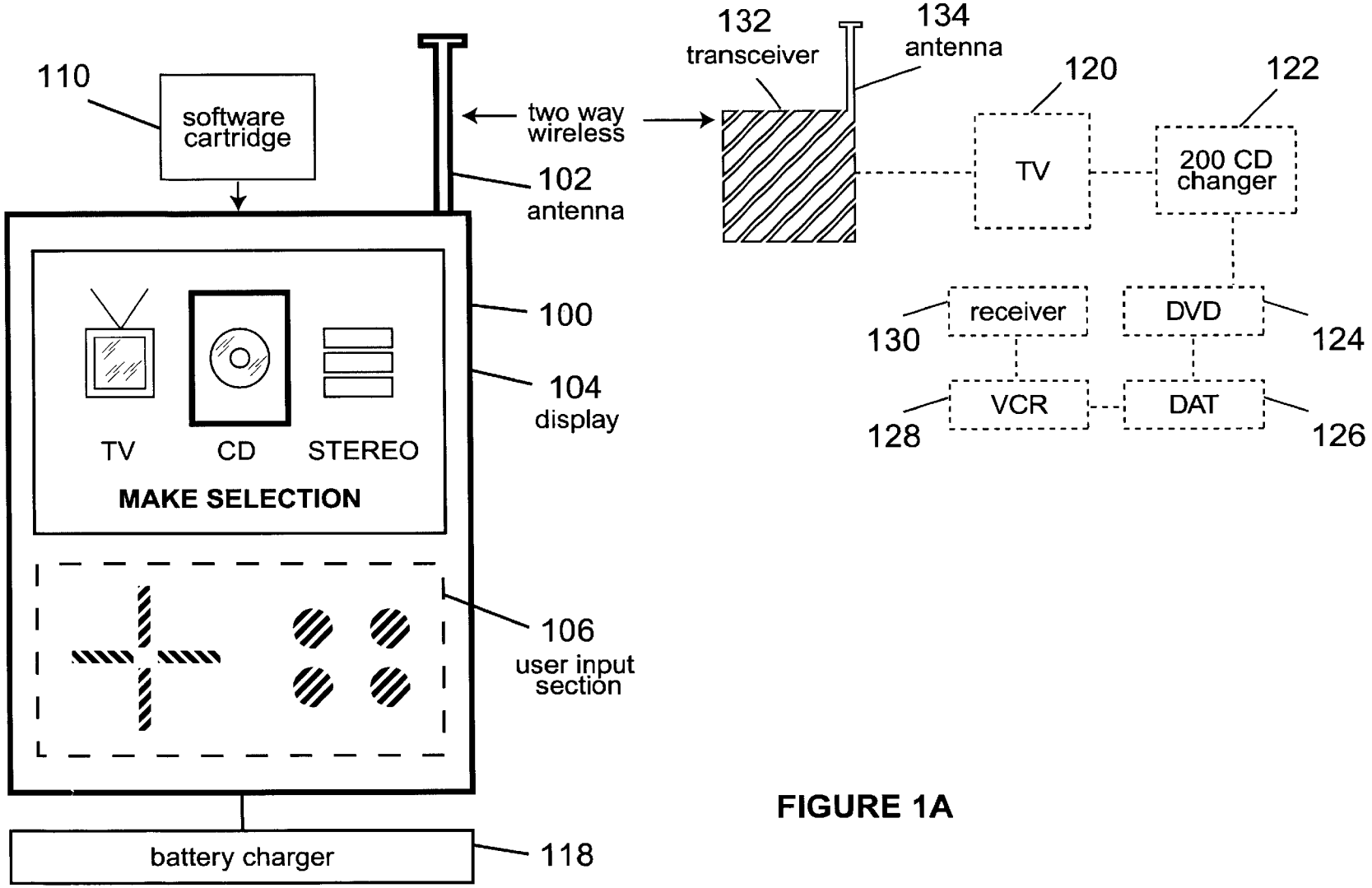
FIGS. 1*a* and 1*b* are high-level block diagrams of the system for remotely controlling audio/video/data equipment in accordance with the present invention.
Figure 1B:
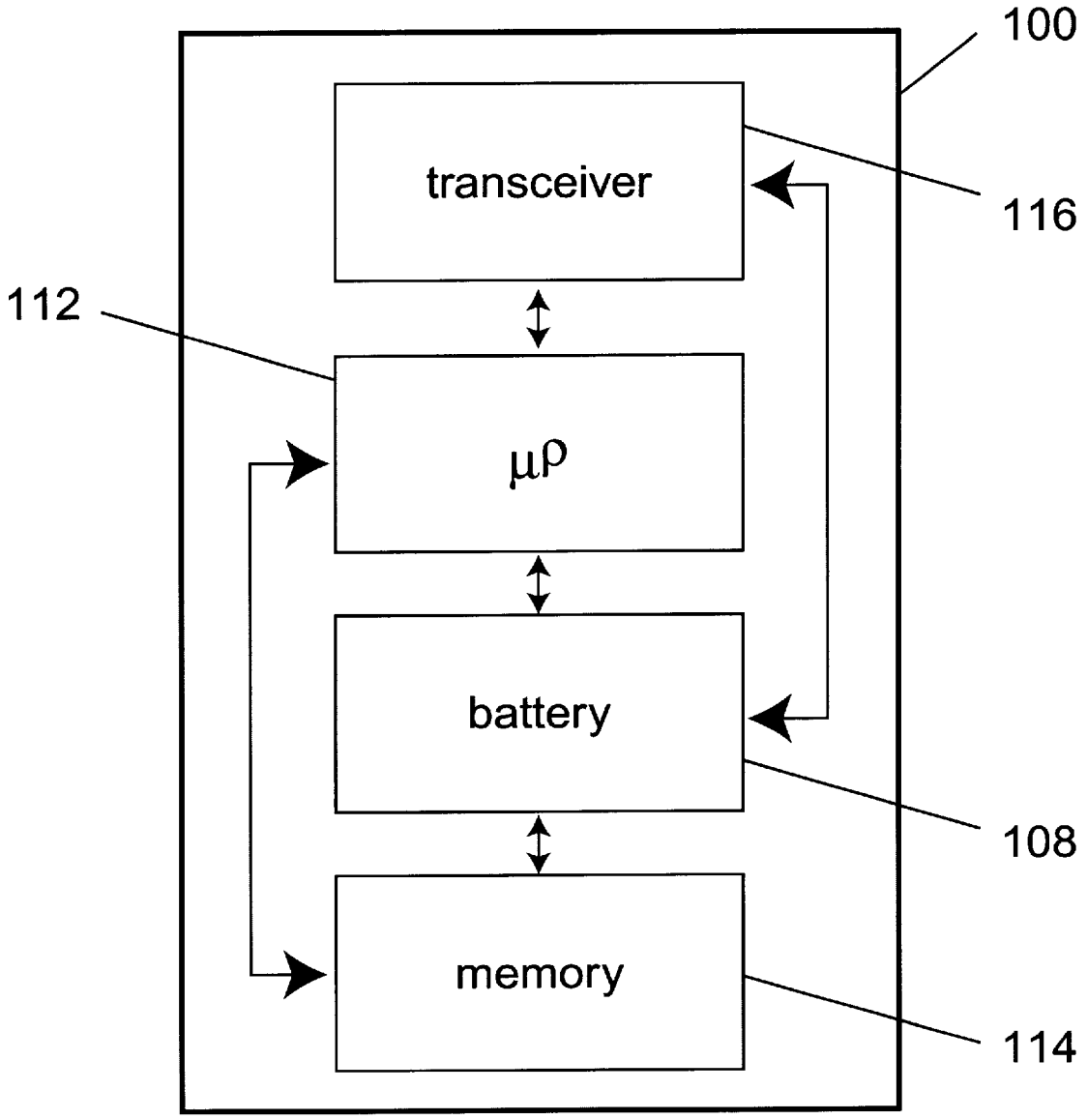

FIGS. 1*a* and 1*b* show a block diagram of the remote control unit and various multimedia components according to the present invention. Remote control unit 100 includes antenna 102 for transmitting and receiving radio-frequency (RF) signals to/from another antenna as will be explained hereinbelow. Remote control unit 100 further includes a display 104 for providing a graphical user interface (GUI). This may be a liquid crystal display (LCD), for example. The display 104 graphically represents commands as issued by the user to control various functions in multimedia components and also displays the status of the components. Remote control unit 100 also includes user input section 106 including control keys for allowing the user to enter commands. Using the control keys, for example, the user can manipulate graphical representations (objects) on the display 104, that is, move the cursor up, down, right, left along the scroll-down menu, to select the desired function by clicking on the appropriate graphical object (icon), etc.

An internal battery 108 supplies power to the various components in the remote control unit 100 including the display 104. Further included in the remote control unit 100 is a cartridge 110 which plugs into the remote control unit 100 for storing software (a binary program). This software contains specifications for controlling and operating the multimedia components as shown in FIG. 1. A microprocessor 112 (programmable controller) controls the operation of the unit by processing data retrieved from the software cartridge 110 and/or a memory 114 for storing various data (including control programs which are executed by the microprocessor 112). The remote control unit 100 also includes a transmitter/receiver (transceiver 116) for performing the appropriate processing operations (modulating signals, etc.) such that information carrying radio-frequency (RF) signals are transmitted/received to and from the remote control unit 100. Namely, the transceiver 116 receives, via the antenna 102, the information carrying signals from another transceiver and passes the received information for processing by the microprocessor 112. Alternatively, the transceiver 116 may transmit the information carrying signals, also via the antenna 102, as supplied by the microprocessor 112. It is understood, of course, that various other components, such as various integrated circuits (IC), etc., are contained in the remote control unit 100 to carry out the operations as described hereinbelow. However, for brevity, the description of these components is omitted as being non-essential to the understanding of the present invention.

Further shown in FIGS. 1*a* and 1*b* are a battery charger 118 for charging the internal battery 108 in the remote control unit 100. As known to those skilled in the art, the battery charger 118 plugs into any wall outlet at one end and is connected to the internal battery 108 via a plug, for example, at another end. As a result, the internal battery 108 may be recharged by the user if the indicator for low battery (not shown) is on, for example.

In addition, FIG. 1*a* shows a representative multimedia system comprised of various components (devices). For example, included in the system is a television set (TV) 120, a 200 CD changer 122, a DVD device 124, a DAT device 126, a VCR 128, and an AM/FM receiver 130. The devices are interconnected via a serial control link which operates in the following manner. If commands are received by a particular device which are not directed thereto, this device merely passes the commands to the next device along the serial control link. The protocol is designed in such a way that each device either responds to the commands or passes them through. Similarly, when a particular device sends information via the serial control link, other devices simply function as pass-through components. The protocol used in such serial control link is known to those skilled in the art and will not be explained herein.

The multimedia system further includes a transceiver 132 including an antenna 134 connected to one of the devices in the system, namely the TV 120 as shown in FIG. 1*a*. The transceiver 132 is substantially identical to the transceiver 116 contained in the remote control unit 100 and performs the same functions of receiving/transmitting information carrying signals. That is, information from the DVD player 124, for example, is sent via the serial control link to the transceiver 132, and then transmitted via the antenna 134 to the remote control unit 100. Similarly, the information carrying signals from the remote control unit 100 are transmitted via the antenna 102 to the transceiver 132. The transceiver 132 performs the appropriate processing operations by receiving and demodulating the signal, etc. and sending the received information as obtained from the demodulated signal via the serial control link to the intended recipient, that is one of the devices in the multimedia system.

The operation of the present invention as illustrated in block diagram form in FIGS. 1*a* and 1*b* will now be explained. When the user turns the power on in the remote control unit 100, the microprocessor 112 executes an initializing routine. The graphical display 104 on the remote control unit 100 is activated, and the transceiver 116 sends a status request to the transceiver 132 connected to the system. The status request queries each device in the multimedia system to identify itself by sending an ID code that is unique to that device. That is, each device in the multimedia system receives the status request and responds by transmitting its own ID code via the serial control link and the transceiver 132.

When the ID codes returned from the transceiver 132 are received by the remote control unit 100 and the transceiver 116 in particular, the received information is supplied to the microprocessor 112 for appropriate processing. Namely, by executing specific instructions in the memory 114 as obtained from the cartridge 110 containing the specifications for the system components, the microprocessor 112 is operative to display graphical representations of each device on the display 104. If the microprocessor 112 determines that one or more of the received ID codes does not have a corresponding device specification in the cartridge 110, an error message is displayed on the display 104 indicating by a graphical block representation that an unknown component is present in the system. In this situation, the user may update the information in the cartridge 110 by obtaining a new cartridge containing the specifications for all of the components in the system.

After the initialization procedure whereby each of the devices in the system is displayed on the display 104, the user may select any of the devices by manipulating the cursor on the display 104 via the control keys. Thus, the microprocessor 112, by executing appropriate program instructions, constantly monitors the user input section 106 to detect whether any of the keys has been activated. If so, the microprocessor 112 interprets the command, for example, determines which key has been activated and performs the corresponding operation under the control of the program stored in cartridge 110 or in memory 114.

By selecting a particular device on the display 104 via the user input section 106, all of the functions pertaining to the selected device become available such that the user can carry out any operation pertaining to the selected device by simply moving the cursor to the graphical representation of the operation (or a pull-down menu) and activating his selection. It is as if the user has access to all of the buttons, switches, etc. on the multimedia device that are clearly labeled in an easy-to-understand language with a user-friendly explanation as to their function without the need to read the accompanying manual to determine what the switch does.

For example, if the user selects the TV 120, then a pull-down menu appears on the display 104 with the following functions "increase volume", "decrease volume", "increase channel by 1", "decrease channel by 1" for example. Another pull-down menu appears if more functions are selected, whereby the user may scroll through such additional menus while activating or deactivating desired operations on the TV 120. The number of menu items, however, that are displayed on the display 104 is balanced against the number of menus to avoid two extreme situations pertaining to the graphical interface. That is, the extent of description of each function on the display is weighed against the number of menus that the user has to scroll through to get to the desired operation.

As is apparent from the above, the user may browse through all of the devices in the system by moving the cursor on the display 104 from one corresponding graphical object to another. During the browsing (or function control) operation, each device responds with its status indicating whether the device is on or off, whether the selected function has been performed successfully, etc. by sending the appropriate information carrying signal via the serial control line to the transceiver 132 and then to the remote control unit 100. This information is then received by the antenna 102 and is processed by the transceiver 116. Then, the microprocessor 112 executes the appropriate instructions to display the received information on the display 104.

Figure 2:
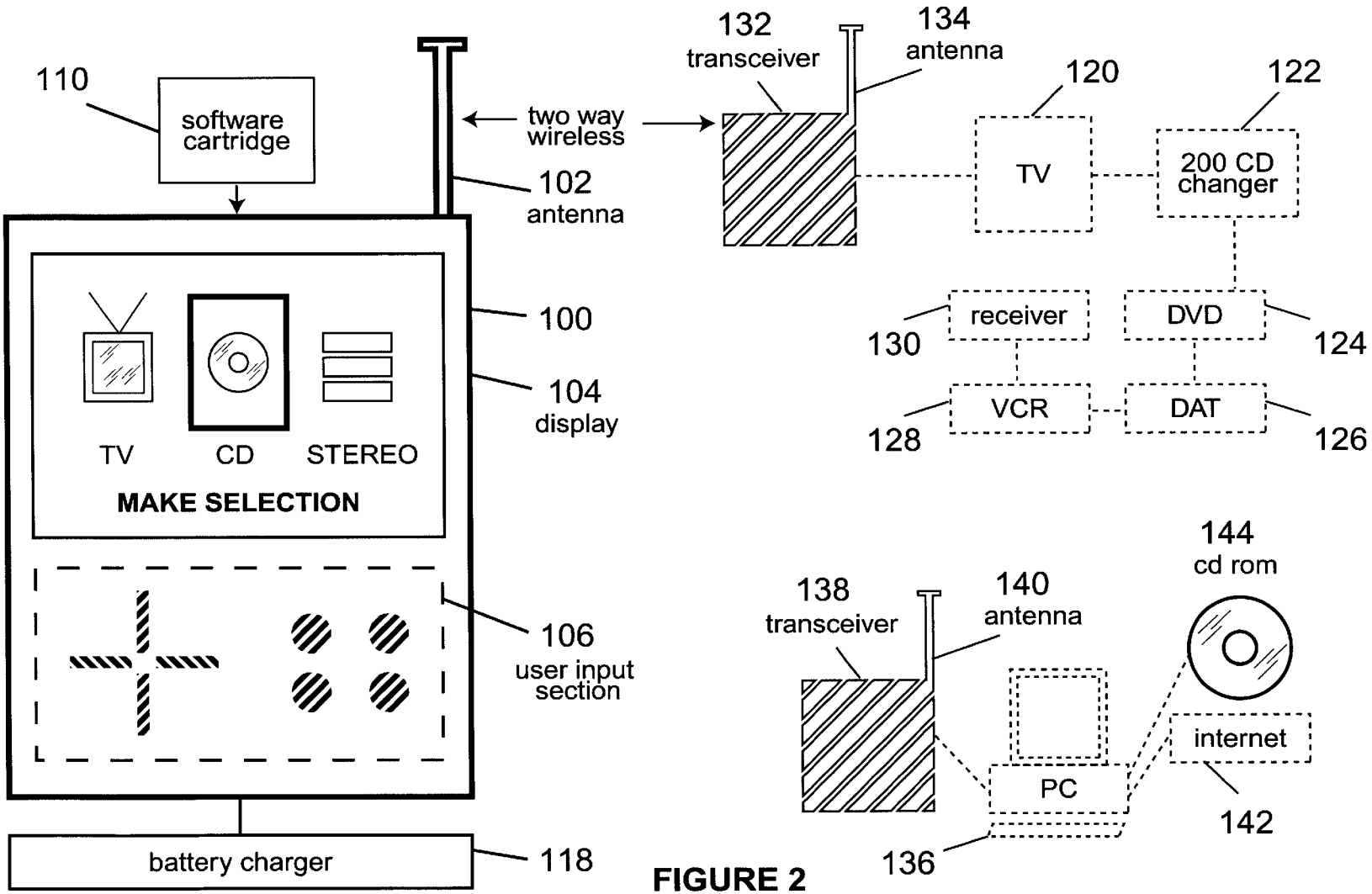
FIG. 2 is a block diagram of the present invention in accordance with one aspect thereof.

Another aspect of the present invention is shown in FIG. 2. A personal computer 136 (PC) is connected to a transceiver 138 with an antenna 140 substantially identical in operation and design to the transceivers 116, 132 and antennas 102, 134. The PC 136 has access either to a remote (the Internet 142) or local (CD-ROM 144) database containing, for example, title/track names of CDs, minidisks, etc. Alternatively, or in addition, the database may contain TV listing or VCR plus codes, that is codes for recording TV programs. Access to the Internet 142 is provided via a modem or network card attached to the PC 136 and an Internet Service Provider, as known to those skilled in the art.

The remote control unit 100 of FIG. 2 has one of its control keys labeled "Detailed Info". Alternatively, the operation of this key may be incorporated into the graphical interface and displayed on the display 104 for activation via the cursor. When the "Detailed Info" operation is initiated, the remote control unit 100 under control of the microprocessor 112 sends a request for detailed information via the transceiver 116 to the PC 136. The request, as represented by the information carrying signals, is received by the antenna 140 and is processed by the transceiver 138. Following the processing by the transceiver 138, the request is supplied to the PC 136. The request for detailed information may include, for example, a request for the TV listing or the VCR plus codes. The PC 136 retrieves the desired information from the database 142, 144 and transmits it to the remote control unit 100. Such information, displayed on the display 104, then becomes available to the user who may browse through the displayed TV listing, for example, or may record the program on the VCR 128 using the displayed VCR plus codes.

Alternatively, or in addition, the request for detailed information transmitted from the remote control unit 100 may include codes from CDs, minidisks, etc. of the multimedia system components. Namely, each recording on the CD or minidisk can be uniquely identified by a code recorded in a preselected portion of the recording medium. By matching this code in the database 142, 144, the title/track of the recording can be determined. That is, the CD player 122, for example, transmits such codes of the CDs located in the CD player 122 to the remote control unit 100. The remote control unit 100 sends a request for detailed information that includes one or more codes received from the CD player 122. When the PC 136 receives these codes, the database 142, 144 is searched, and the corresponding title/track names are retrieved. This retrieved information is then transmitted from the PC 136 to the remote control unit 100 for display. Consequently, the user may be listening to a particular recording while the display 104 on the remote control unit indicates the title/track name of that recording.

In addition, playlists may be created based on the database and the recording media in the multimedia system components. In particular, the user may determine all of the title/track names of the CDs in the CD player 122, for example, using the databases 142, 144 as explained hereinabove. Then, the user may operate the remote control unit 100 to select a playlist of recordings on the display 104. The user-selected playlist is transmitted to the CD player 122 via the transceivers 116, 132 and stored in the memory of the CD player 122, such that the recordings on the playlist are carried out in accordance with the playlist.

It is understood, of course, that while the user input section 106 is comprised of control keys in the representative embodiment of FIGS. 1*a* and 1*b,* any other cursor-controlling device, such as an eraserhead, etc. may be used instead.

Further, as previously mentioned, new multimedia devices controllable by the remote control unit 100 can be easily added to the system by upgrading/updating the removable cartridge 110. Alternatively, the program specifications for various multimedia devices and the graphical user interface supporting these devices may be stored in the memory 114 of the remote control unit 100. Updates for new devices may be performed via a cable connecting the remote control unit 100 to the PC 136 for downloading new specifications from some storage medium or database, as provided by the manufacturers, for example.

Further, while the transceivers 116, 132, 138 have been representatively described hereinabove as transmitting/receiving RF signals, it is understood by those skilled in the art that an infrared mode of communication may be used just as well to communicate between the remote control unit 100, multimedia system and PC 136.

Having described specific preferred embodiments of the invention with reference to the accompanying drawings, it is to be understood that the invention is not limited to those precise embodiments, and that various changes and modifications may be effected therein by one skilled in the art without departing from the scope or the spirit of the invention as defined in the appended claims.

What is claimed is:

1. A remote control device for wirelessly communicating with a multimedia system comprised of a plurality of audio/video devices, said multimedia system including a first transceiver for wirelessly transmitting and receiving a number of signals, comprising:

a memory storage for storing specifications data for each of the audio/video devices, said specifications data being operative to have the audio/video devices perform a number of functions in response to command data;

a user input section for inputting said command data representative of a function to be performed in at least one of the audio/video devices;

a display for displaying a number of graphical objects corresponding to respective ones of the audio/video devices, and for displaying a menu including said number of functions corresponding to said respective audio/video devices such that said function is selected from said menu in response to said user input section, wherein for each said audio/video device that is unknown to said remote control device, a graphical block indicating that said device is unknown is displayed on said display;

a programmable controller for processing the input command data corresponding to the selected function on said display; and a second transceiver for transmitting to said first transceiver a first signal corresponding to the processed command data such that said at least one audio/video device is operative to perform the selected function, and for receiving from said first transceiver a second signal corresponding to status data indicating whether the selected function has been performed.

2. The device according to claim 1, wherein said user input section is comprised of a number of keys for manipulating the graphical objects on said display.

3. The device according to claim 1, wherein the signals transmitted and received by said first and second transceivers are radio frequency signals.

4. The device according to claim 1, wherein the audio/video devices in said multimedia system are connected to each other via a serial control link.

5. The device according to claim 1, further comprising a general purpose computer and a third transceiver connected to said computer such that said second transceiver transmits a third signal corresponding to the processed command data and representing a request for information to said third transceiver.

6. The device according to claim 5, wherein said first transceiver transmits said third signal representing information about a recording medium in said at least one audio/video device such that said third signal is received by said second transceiver and re-transmitted to said third transceiver for identifying said information by said computer.

7. The device according to claim 5, further comprising a database, and wherein said computer accesses said database for responding to said request for information, and transfers response information to said third transceiver for transmitting a fourth signal representing said response information to said second transceiver.

8. The device according to claim 7, wherein said second transceiver receives said fourth signal, said programmable controller being operative to process said fourth signal and display said response information corresponding to said fourth signal on said display.

9. The device according to claim 7, wherein said computer is selectively connected to said database via a modem or a network card.

10. A method for remotely controlling through a remote control device a multimedia system comprised of a plurality of audio/video devices, said multimedia system including a first transceiver for wirelessly transmitting and receiving a number of signals, said method comprising the steps of:

storing specifications data for each of the audio/video devices, said specifications data being operative to have the audio/video devices perform a number of functions in response to command data;

inputting at a user input section said command data representative of a function to be performed in at least one of the audio/video devices;

displaying a number of graphical objects corresponding to respective ones of the audio/video devices, and displaying a menu including said number of functions corresponding to said respective audio/video devices such that said function is selected from said menu in response to said user input section, wherein for each said audio/video device that is unknown to said remote control device, a graphical block indicating that said device is unknown is displayed on said display;

processing the input command data corresponding to the selected function on said display; and transmitting to said first transceiver a first signal corresponding to the processed command data such that said at least one audio/video device is operative to perform the selected function, and receiving from said first transceiver a second signal corresponding to status data indicating whether the selected function has been performed.

* * * * *